United States Patent [19]

Supran

[11] 4,071,242

[45] Jan. 31, 1978

[54] ELECTRICALLY CONDUCTIVE TENNIS BALL

[76] Inventor: Lyle David Supran, 18A Blackheath Rise, London S E 13, England

[21] Appl. No.: 460,805

[22] Filed: Apr. 15, 1974

Related U.S. Application Data

[63] Continuation-in-part of Ser. No. 238,888, March 28, 1972, abandoned.

[30] Foreign Application Priority Data

Mar. 30, 1971 United Kingdom ..... 8176/71

[51] Int. Cl.[2] ..... A63B 61/00

[52] U.S. Cl. ..... 273/61 R; 273/58 G; 273/58 K; 273/58 B; 273/61 B

[58] Field of Search ..... 273/31, 58 R, 58 G, 273/58 K, 63, 61 R, DIG. 6, DIG. 9, 213, 61 A, 61 B, 61 C, 61 D; 340/172.5, 261, 384, 323, 121; 200/61.11

[56] References Cited

U.S. PATENT DOCUMENTS

| | | | |
|---|---|---|---|
| 3,265,392 | 8/1966 | Degner et al. | 273/63 |
| 3,310,659 | 3/1967 | Appostle et al. | 340/323 X |
| 3,415,517 | 12/1968 | Krist | 273/29 R X |
| 3,774,194 | 11/1973 | Jokay | 272/3 X |
| 3,854,719 | 12/1974 | Supran | 273/61 R |

FOREIGN PATENT DOCUMENTS

| | | |
|---|---|---|
| 206,864 | 8/1966 | Sweden. |

*Primary Examiner*—William H. Grieb
*Assistant Examiner*—T Brown
*Attorney, Agent, or Firm*—Lockwood, Dewey, Zickert & Alex

[57] ABSTRACT

A tennis ball apparatus having an electrically conductive outer surface. The electrically conductive material is substantially uniformly distributed through a cloth covering which when bonded to the spherical core of the ball the electrically conductive material will be distributed from the core of the ball to the outer surface thereof. The outer covering of the ball could be made from a material of wool, nylon and metal. The metal could be stitched, weaved or needled into the cloth covering.

11 Claims, 11 Drawing Figures

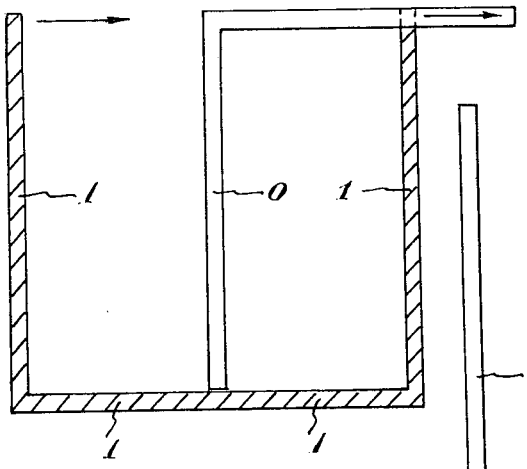
Fig. 4
Fig. 5.
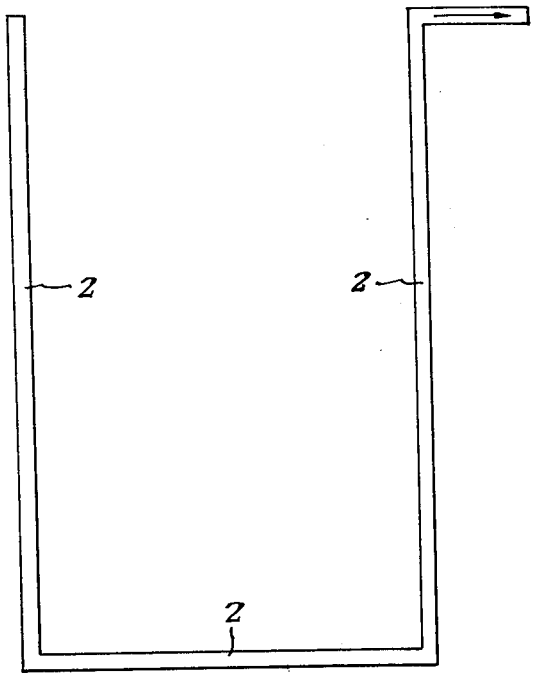
Fig. 6.
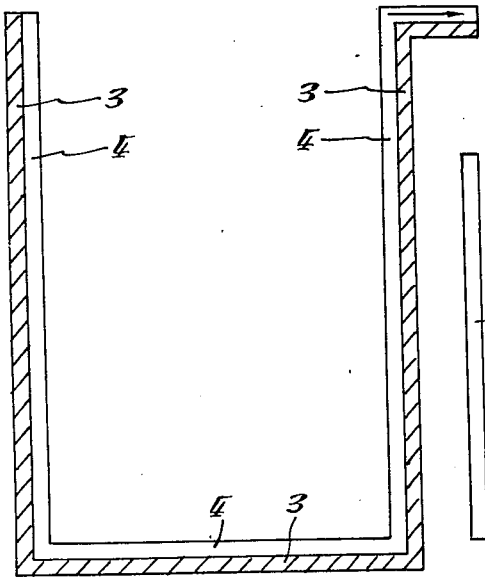
Fig. 8.
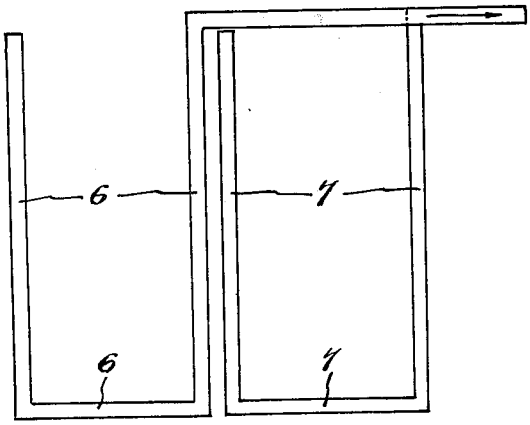

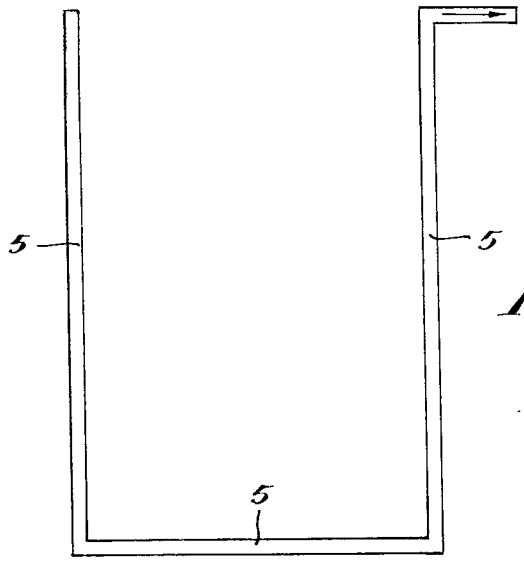
Fig. 7.
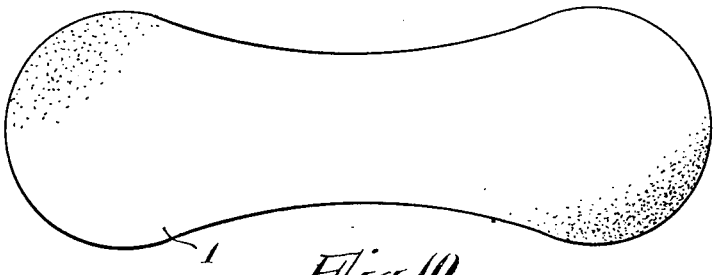
Fig. 10.
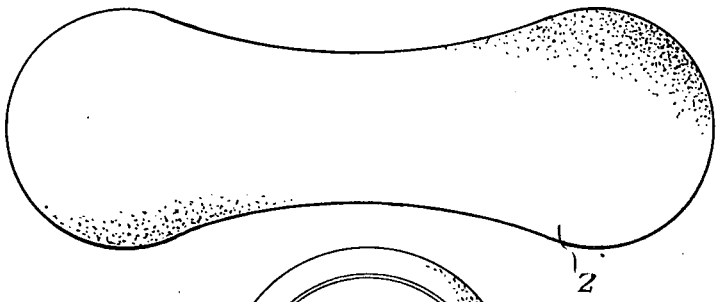
Fig. 11.
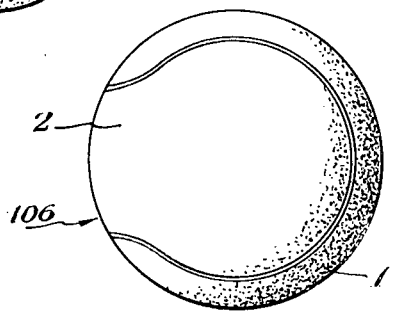

ELECTRICALLY CONDUCTIVE TENNIS BALL

CROSS REFERENCE

This application is a continuation-in-part application on my application Ser. No. 238,888 (abandoned) filed Mar. 28, 1972 and entitled "Automated monitoring and arbitration system".

BACKGROUND OF THE INVENTION

The present invention relates to tennis balls having electrically conductive outer surfaces for use in a computer system for assisting an umpire in a tennis match.

In a tennis match a tennis ball may travel at 100 m.p.h. An umpire or linesman who may be 30 feet from a contact of that ball with the surface of the tennis court is throughout the match required to decide whether the ball bounced in-play or out-of-play.

Such a decision involves comparing the position of an area of contact with the positions of certain lines on the court. These lines may be marked on or attached to the court in various ways or may indeed be an integral part of the court surface itself. Such lines include the line of the top of the net dividing the court into two halves.

As an indication of the degree of difficulty of such a decision, if the closest point of an area of contact to a specific line is 1 inch from that line and if the ball was travelling at 100 m.p.h. immediately prior to contact and if the umpire or linesman concerned is 30 feet from the contact, it can be very difficult for him to judge whether the ball did or did not touch the line. Judgements of similar or greater difficulty can frequently be required from an umpire or linesman during a tennis match. Furthermore his decision is required as soon as possible after the bounce and preferably before the ball has been struck again after the bounce. At 100 m.p.h. a ball will travel the full length of a tennis court in about ½ second.

If in the example above, the closest point of the area of contact to the line had been 6 inches instead of 1 inch the judgement would generally be easier. This suggested distance of 6 inches is purely arbitrary, automatic decisions could be provided by extensions of the system to be described for a ball which bounced or landed anywhere on the court. In general, however, the umpire or linesman requires assistance in cases where the ball bounces closer to a line than a few inches. It is an object of this invention to provide an umpire, automatically with an accurate and timely decision for such cases.

Quite different situations arise in a tennis match where it is much simpler for an umpire to decide unaided whether the ball is in-play or out-of-play and hence to decide the latest score than to use an automatic system to make these decisions. For example, when a player strikes a ball before it bounces it is considered according to the rules of tennis that had the ball bounced it would have bounced in-play and therefore no decision of the type given in the example of the previous paragraphs is required. Again if a player hits a ball completely out of court, then although by expensive extensions of the system to be described it could operate similarly to the example, it will be much simpler and more convenient for an umpire to make the decisions mentioned above. Again if during a rally a player catches the ball and puts it in his pocket, it is much simpler for an umpire to make such decisions. cl SUMMARY OF THE INVENTION The system has therefore been designed so that an umpire is provided with automatic decisions where difficult and rapid judgements are required as previously exemplified, but can himself input information to the computer system when this is simpler. An umpire's input unit may for example be a keyboard connected to his visual display unit (VDU) and enabling him to interact with the computer system by, say, requesting the computer to display on his VDU statistics accumulated during the match. In the system to be described the umpire is empowered to override the automatic system at all times except where simultaneous input of information occurs from both umpire and from a contact of the ball giving rise to an automatic decision as to whether the ball bounced or landed in-play or out-of-play.

With extensions of the system to be described an umpire could, by using his input unit, control output of information from the computer to a public scoreboard or a public address system. An umpire's input unit could alternatively be a voice input unit causing the computer to respond to his voice commands.

The basic computer system to be described in greater detail hereinafter has been designed with the object of assisting an umpire in a tennis match, particularly where difficult judgements are required to be rapidly made as to whether a ball has bounced or landed in-play or out-of-play. The design is such that the system can be expanded for example by the addition of a public scoreboard or public address system to which the computer can output information under the control of the umpire. Likewise there are several possible alternative input units the umpire could use such as a keyboard or a voice input unit and the basic system can be expanded to receive information input from for example impacts of the ball with the top of the tennis net and say from signals enabling detection of a foot-fault when a player serves.

According to an important aspect of the present invention there is provided a computer system for assisting an umpire in a tennis match, means comprising a plurality of tennis balls for playing in said tennis match, each of said tennis balls having a covering surface of cloth which is electrically conductive. The computer system also includes: means comprising a plurality of flat form, multi-conductor, flexible cables attached to playing surfaces of a tennis court for enabling in conjunction with said tennis balls the production of first output electrical signals, said first output electrical signals being indicative of the locations on said tennis court where the said balls bounce; means comprising a plurality of computer terminals for transmitting or receiving as directed by said umpire second electrical signals in connection with the occurrence of discrete events associated with said tennis match; indicator means comprising a plurality of indicator devices for indicating in response to applied control signals the status of one or more selected parameters in said tennis match; and means comprising said computer responsive to said first output electrical signals and said second electrical signals for providing in accordance with the rules of tennis control signals for application to said indicator means whereby the status of said selected parameters in said tennis match can be indicated.

BRIEF DESCRIPTION OF DRAWINGS

The present invention will now be described in greater detail by way of example with reference to the accompanying drawings, wherein:

FIGS. 4 through 8 show individual cable layouts on the tennis court;

FIGS. 10 and 11 show the construction of a tennis ball having an outer electrically conductive surface suitable for use with the computer system for assisting an umpire in a tennis match.

DESCRIPTION OF THE PREFERRED EMBODIMENT

Figure 1:
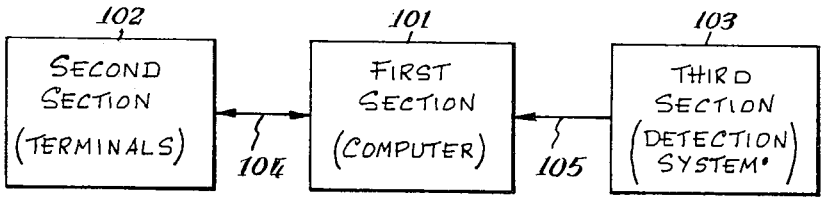
FIG. 1 is a block diagram showing the three main sections of one preferred form of computer system for assisting an umpire in a tennis match.

Referring first to FIG. 1, the basic computer system comprises three sections 101, 102 and 103. In the following description, each of these sections is defined and then the operation of the basic computer system as a whole is described and exemplified. The first two sections 101 and 102 relate to equipment which is well known in the computer industry. The third section 103 relates to equipment which is believed is only in part well known. The first section 101 includes a mini-computer and two interfaces (one to each of the other sections). Such equipment is available from C.A.I. (Computer Automation Incorporated). The two interfaces required are designated the dual CRT interface and the 16 bit input/output interface. These two interfaces are used in conjunction with an ALPHA 16 mini-computer such as is available from C.A.I. An alternative computer which could be used is a Direct Function Data Processor such as is described in U.S. Pat. No. 3,631,401. Interfaces would similarly be required for connection to this data processor of inputs and outputs as described in that Patent.

The second section 102 includes one or two terminals such as the TD700 Terminal Input and Display System available from Burroughs Machines Limited. The TD700 equipment includes a display sub-system (VDU), a keyboard sub-system and a communications interface. Such a terminal can be interfaced to an ALPHA 16 mini-computer using a dual CRT interface available from C.A.I.

The third section 103 includes a detection system. This system consists of firstly, tennis balls whose covering surface of cloth is electrically conductive and secondly, flat form strip or tape multi-conductor, flexible cables such as the 19 way Biccastrip available from B.I.C.C. (British Insulated Callender Cables Limited). Such a detection system can be interfaced to an ALPHA 16 mini-computer using a 16 bit input/output interface available from C.A.I.

The above three sections are represented in the block diagram of FIG. 1 in which the arrowed lines 104 and 105 connecting sections, indicate the directions in which information is transferred electronically within the system.

The first and second sections 101 and 102 are commercially available. The third section 103 comprising the detection system is shown in greater detail in FIGS. 2 to 11.

Referring to FIGS. 10 and 11, the detection system includes a tennis ball 106 whose covering surface of cloth is electrically conductive. Cloth used in the manufacture of a tennis ball may be cut in the identical approximate shapes 1 and 2 schematically in FIG. 10, prior to attachment by adhesive and heat processes believed to be well known to a spherical core of flexible material which may be gas filled or otherwise. The electrical conductivity is imparted by stainless steel. The cloth is woven from wool, Nylon and Brunsmet stainless steel; this latter is available from Brunswick Corporation. Brunsmet stainless steel, staple in sliver form, can be processed, by weaving methods believed to be well known, in various filament diameters, lengths and densities and in variable weight ratios with wool and Nylon to produce conductive cloth. By manufacturing processes believed to be well known, tennis balls can be manufactured whose covering surface of cloth incorporates stainless steel as well as the usual constituents of wool and Nylon. Such a tennis ball whose covering surface of cloth is electrically conductive is used in the detection system of the third section; ideally the cloth is uniformly electrically conductive, but in practice an approximation to a uniform distribution is adequate. The electrical conductivity imparted by stainless steel in the above description could alternatively be imparted by other metals such as aluminium or copper or by electrically conductive carbon fibres. Alternatively, Brunslon can replace Brunsmet and Nylon; Brunslon is a fine spun yarn containing Brunsmet and Nylon and is available from Brunswick Corporation. Use of Brunslon can improve the uniformity of distribution of steel in the cloth. The incorporation of electrically conductive material into cloth used in the manufacture of tennis balls can alternatively be effected by processes believed to be well known in the textile industry such as needling or stitching.

The colour of the electrically conductive cloth used in the manufacture of a tennis ball suitable for the detection system can be changed by dyeing processes believed to be well known in the textile industry. Suitable colours are fluorescent yellow, red and white.

Figure 2:
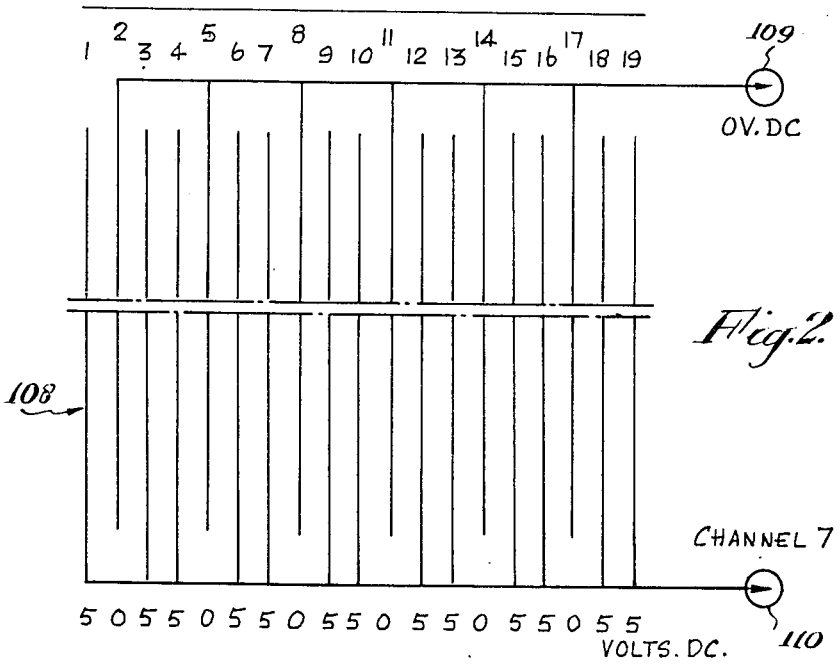
FIG. 2 shows in diagrammatic form, an electrically conductive tape for laying on a tennis court.

In the third section the detection system also includes flat form multiconductor, flexible cable 108 such as 19 way Biccastrip illustrated in FIG. 2 each such tape constituting a channel. The conductors which are parallel are of malt copper or other metal and the flexible supporting material is polyester or other resin. The copper conductors are not covered by insulating material. The polyester support is adhesive on the side away from the copper. The cable 108 as shown has 19 conductors (1 through 19). These conductors 1 through 19 are formed on one surface of the polyester flexible supporting material by a printed circuit technique, and are separately insulated from one another.

Each of the 19 conductors constituting one channel are connected to a source of DC potential derived from the ALPHA 16 mini-computer via terminals 109 and 110. These potentials are either +5V DC (terminal 10) or 0V DC (terminal 109) as indicated in FIG. 2, where merely for clarity the +5V and 0V connections are shown at opposite ends of the Biccastrip cable 108. In practice all such connections are at the same end of the Biccastrip channel.

Figure 3:
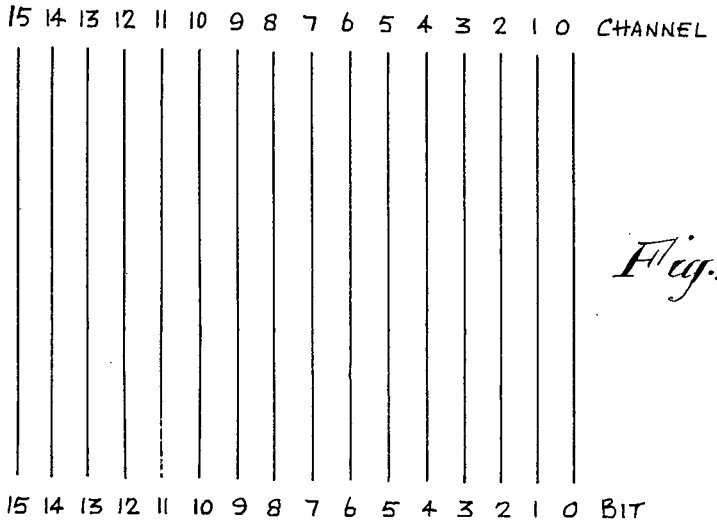
FIG. 3 shows the numbering adopted for the channels connected to the 16 bit input/output interface of the computer system.
Figure 9:
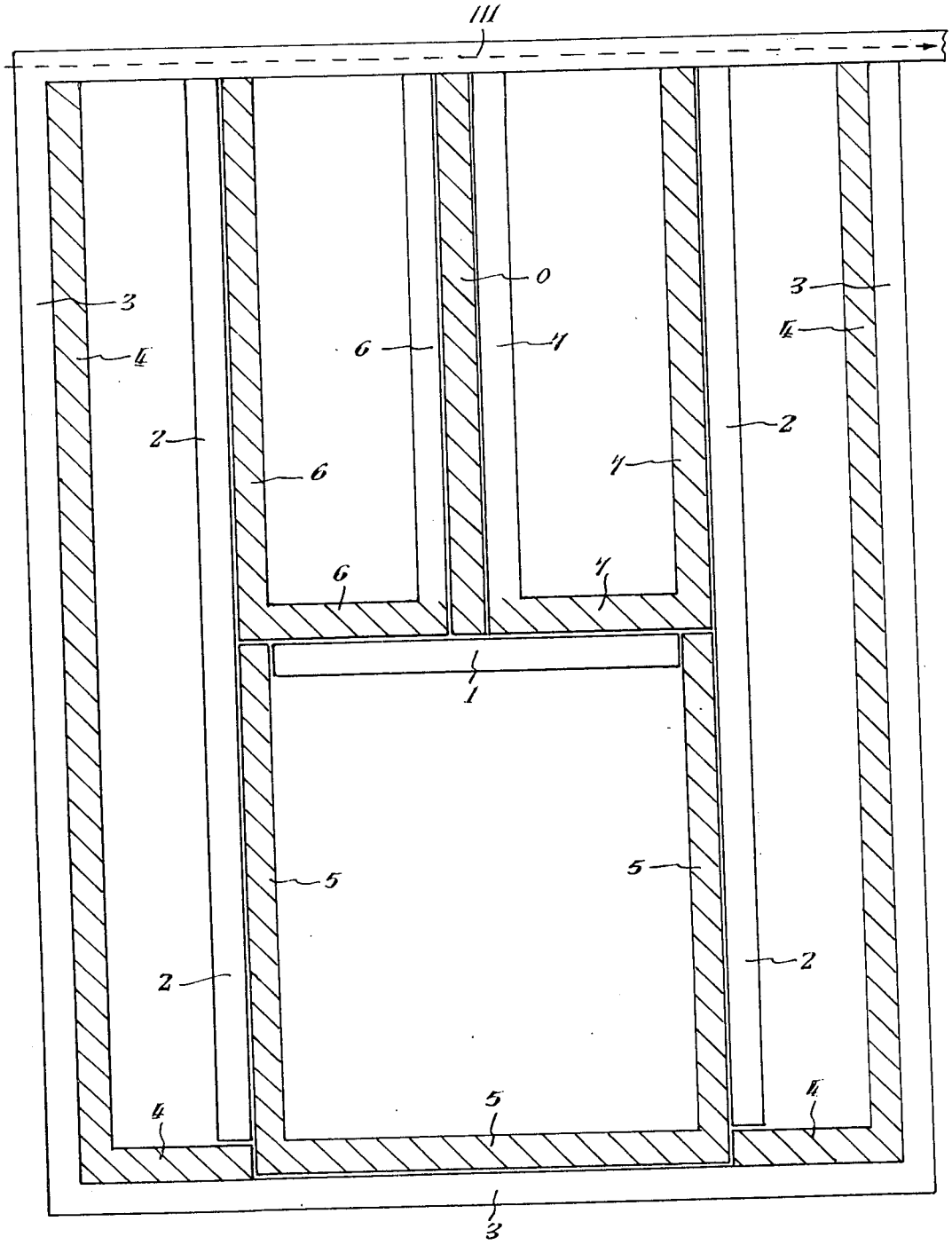
FIG. 9 shows one half of a tennis court with the cable layouts of FIGS. 4 through 8 appropriately superimposed.

FIG. 3 shows the numbering adopted for channels connected to the 16 bit input/output interface and FIGS. 4 through 9 show the physical significance on one half of the court of each of the channels 0–7. The general layout of half the electrically conductive cables on the court is shown in FIG. 9, whilst FIGS. 4 through 8 show individual sections of the half court in greater detail. Channels 8 to 15 are connected to equivalent tapes on the other half of the court to correspond with the channels 0 to 7. In FIG. 9, the tennis net is indicated by the dotted line 111. The numbering of the channels is also the sequence in which they are physically attached to the court. FIGS. 4 through 8 indicate the shapes of each channel on one half of the court and indicate that connection of each channel to the interface is effected by an extension of each channel running under the net 111 and parallel to it along the surface of the court, so as not to interfere with play. Channels can be superimposed one above the other, each separated from the outer by an insulating material. Biccastrip is flexible and can be folded on itself and ironed flat so as to effect a change in direction of 90°, leaving the same surface uppermost on both sides of the right-angle and avoiding contact between conductors. FIG. 9 illustrates the result of attaching to the half-court surface channels 0–7 inclusive in that sequence and in the shapes indicated in FIGS. 4 through 8. Some channels are only partly visible after superimposition of other channels. FIG. 4 illustrates the first channel 0 to be attached to say the right hand half of the court as viewed by an umpire positoned at one side of the court and in line with the net.

The arrowed lines are parallel to the tennis net. Channels 0 4 and 5 use Biccastrip which has been given an overall fluorescent yellow appearance as a result of painting the polyester insulation of the Biccastrip. The transparent polyester insulation is painted fluorescent yellow on the side away from the matt conductors. There results a channel which when attached to the surface of the court by for example using an adhesive has the overall appearance of a yellow line, the fluorescent yellow colour showing through the insulation separating the 19 copper coloured conductors of the cable 108. Similarly channels 1, 2 and 3 can be given an overall say green colour to match the colour of the court surface. Channels 6 and 7 are so painted as to appear yellow along part of their lengths and green along the remainder. Alternatively in the case of channel 6 (or 7) an additional channel 8 (or 9) may be used to obviate using two colours on one channel. If this approach is adopted, however, then either a second 16 bit input-/output interface or an additional interface for 64 input bits, also available from C.A.I., is used in order to accommodate the requirement for extra channels.

By using a second interface, input bits additional to those accommodated in the basic computer system can be serviced. This facility can be used to accommodate additional channels attached along the top of the net, to decide if the ball has hit the top of the net, or attached to the surface of the court so as to enable automatic decisions from a greater area of the surface or, for example connected to a voice input system.

Similarly, by using a second interface, output bits additional to those available in the basic computer system can be used to operate a public scoreboard system or a public address system.

The operation as an entity in a tennis match of the basic computer system, using only one 16 bit input/output interface and no 64 input interface or 64 bit output interface is described and exemplified in detail in the following.

At every stage in any tennis match once the winner of a point has been decided, the rules of tennis determine the latest score. The computer is programmed to update the score, according to the rules of tennis as after each point it is instructed as to the winner of that point. The latest score as thus determined is then ready for display to the umpire on a visual display unit.

The winner of each point can be decided either by the umpire alone or by the detection system with the umpires agreement. For the purposes of description the umpire is assumed to operate the keyboard input unit. In practice a slave umpire who can also see and hear the visual display unit operates the keyboard input unit.

If the umpire alone decides the winner of a point he then supplies the computer with the latest score as follows: using the keyboard input unit he keys in the latest score which is automatically displayed to him on his V.D.U., along with the previous score. When he agrees that he has entered the correct latest score this information is transmitted as a message (denoted C) to the computer by depression of a preselected key on the keyboard input unit. If he determines that he has incorrectly entered the latest score, he uses first the edit facility of the V.D.U., to correct his entry and subsequently transmits the correct version to the computer as before.

If the detection system decides with the umpire's agreement the winner of a point, the basic computer system operates by use firstly of the detection system, secondly of the computer, thirdly of the V.D.U. and computer and umpire and fourthly of the computer alone again. Each of these stages will now be described in detail.

Firstly the detection system channels are considered. Each cable 108 has conductors 1, 3, 4, 6, 7, 9, 10, 12, 13, 15, 16, 18, and 19 at +5V DC (see FIG. 2) and conductors 2, 5, 8, 11, 14 and 17 at 0V in the initialized state.

Thus each of the channels 0 to 15 (see FIG. 3) is initially at +5V DC and the corresponding bits 0–15 of the 16 bit input/output interface to which these channels are physically connected are said to be reset (denoted zero).

Consider one of these channel by way of example, say channel 7. If the tennis ball having an electrically conductive surface makes electrical contact on channel 7 between conductors 16 and 17 then the DC potential of channel 7 becomes 0V and the corresponding bit 7 of the 16 bit input/output interface is said to be set (denoted 1). It is at this stage that the computer and its 16 bit input/output interface are used.

Secondly then the computer, including its interface is considered. The setting of any one or simultaneously of several bits of the 16 bit input/output interface causes that interface to generate an interruption of the computer processing. The computer is programmed to respond to this interrupt by reading the 16 bits, called a computer word, into its memory and examining each of the 16 to determine which bits are set. In the example bit 7 is set, but bits 0 through 6 and 8 through 15 are reset. Provided that all 16 bits become reset within 100 milliseconds of the interrupt (as determined from the interrupt generated when the ball leaves channel 7 and breaks contact between conductors 16 and 17) and provided also that they do not all become reset within 100 microseconds after the interrupt (which latter would be too fast to correspond to the bounce of the tennis ball) then a valid bounce of the tennis ball has been detected on channel 7.

As can be seen from FIG. 9, channel 7 represents an area of the tennis court which is, according to the rules of tennis, such that if the ball bounces on it during the playing of a point and subsequent to the service bounce the ball has always bounced in-play, for both singles matches and doubles matches.

The rules of tennis define which channels could detect in-play and which out-of-play ball bounces at each state of every point contested, whatever the score prior to that point, for both singles matches and doubles matches.

For example a valid bounce detected on channel 3 always corresponds to a out-of-play bounce. As soon as a valid out-of-play bounce is detected by the basic computer system, it disables interrupts from the detection section and the contested point has been decided.

Thirdly, computer, V.D.U and umpire interaction is considered. The basic computer system re-enables interrupts which may be caused by the detection system only when the umpire transmits to the computer a message corresponding to depression of a preselected key on his keyboard input unit. This message (denoted A) defines the start of the next point to be contested and is transmitted as the server prepares to serve. Similarly the umpire is enabled to transmit a message (denoted B) to the computer to define the end of a contested point and this message causes the computer to disable interrupts from the detection section.

When a valid in-play bounce is detected, on for example channel 6, the computer stores the corresponding interrupt word in its memory until the umpire again transmits the message denoted B. Again, the umpire is enabled also to transmit a message (denoted C) to the computer to confirm the latest (edited) score. On receipt of the message denoted C the computer deletes stored interrupt words from its memory. Between transmission of the messages denoted B and C the umpire is enabled to transmit a message (denoted D) which causes the computer to display in sequence of occurrence on the umpire's V.D.U all valid in-play bounces detected during play of the point concerned. Each message denoted D causes one such display to remain on the V.D.U until the next message denoted D. The complete sequence of displays can be repeated any number of times by repeated transmission of the message denoted D, until the message denoted C has been transmitted.

When a valid out-of-play bounce is detected, on for example channel 3, the computer after disabling interrupts from the detector section, displays on the umpires V.D.U the latest score. The umpire is enabled to correct if necessary this latest score by using the edit facility of the V.D.U. Transmission of the message denoted C defines to the computer this latest edited score.

If the umpire and detector section simultaneously transmit to the computer, the computer ignores the umpire. The umpire, however, is empowered subsequently to override the computer and detection section decisions by use of his keyboard input unit.

Fourthly, the computer is again considered. Having recorded the latest score, which has been confirmed by the umpire, it is programmed to select ready for a service the sets, defined within the program, of channels which can correspond to in-play service bounces and channels which can correspond to out-of-play service bounces for that latest score for a singles (or doubles) match.

If the service is directed towards that area bounded by channels 7 and 0, as can be determined from the previous score and the rules of tennis, then all other channels are out-of-play channels from the time of contact of the racket and the ball being served to the time of the first subsequent bounce of that ball. For the same time period, similar considerations apply for each of the four areas towards which at appropriate scores services can be directed, these considerations are summarized in Table 1.

TABLE 1

| IN-PLAY CHANNELS BOUNDING SERVICE BOX | CORRESPONDING OUT-OF-PLAY CHANNELS AS THE BALL IS BEING SERVED |
|---|---|
| 0,7 | 1-6, 8-15 inclusive |
| 0,6 | 1-5, 7-15 inclusive |
| 8,15 | 0-7, 9-14 inclusive |
| 8,14 | 0-7, 9-13, 15 inclusive |

If the point being contested is decided by a single service which bounces in-play and is not returned, then after the umpire has input to the computer the information that the served ball has just bounced (which he must do as soon as it has bounced), all channels will subsequently be rendered out-of-play channels by his subsequent transmission of the message denoted B. However, if the point contested involves more than an isolated service, then as soon as the umpire has input to the computer that the served ball has just bounced the sets of in-play channels and out-of-play channels become as indicated in Table 2.

TABLE 2

| | | |
|---|---|---|
| SINGLES | IN-PLAY | 0,1,5,6,7,8,9,13,14,15 |
| | OUT OF PLAY | 2, 3, 4, 10, 11, 12 |
| DOUBLES | IN-PLAY | 0,1,2,4,5,6,7,8,9,10,12,13,14,15 |
| | OUT-OF-PLAY | 3,11 |

An example of the operation of the basic computer system as an entity for a typical contested point from the time of transmission of the message denoted A up to the time of the next message denoted A transmitted by the umpire, will now be described.

The umpire transmits the message A as the server prepares to make contact between racket and ball. If the served ball strikes the net and its first subsequent bounce is in-play, that is in the area bounded by the net and by channels 7 and 0, that service must be taken again.

If the served ball strikes the net and its first subsequent bounce is out-of-play, the next service must be taken.

The interaction between the basic computer system and the umpire in deciding whether a ball bounces in-play or out-of-play after the service contact between racket and ball and futhermore subsequent to the first bounce is illustrated for a case where the service is directed into the area bounded by the tennis net and in-play channels 7 and 0 (refer to Table 1).

If the detection system interrupts the computer with the information that the served ball has bounced on an out-of-play channel, the computer activates an audible alarm on the umpire's visual display unit and disables interrupts from the detection section. The umpire can then display the latest score as updated by the computer and indicate to the computer his agreement with the (edited) latest score by transmission of the message denoted C. If the served ball has bounced in an out-of-play area not monitored by the detection system, the umpire should conclude that the ball bounced out-of-play and transmit the message denoted B which disables interrupts from the detection section. The umpire next inputs the latest score and transmits it to the computer using the message denoted C.

If the detection system interrupts the computer with the information that the served ball has bounced on an in-play channel, the computer is programmed to selecte new sets of definitions of in-play channels and out-of-play channels, such sets being indicated in Table 2.

As soon as possible after each and every service the umpire must transmit a message (denoted E) to signify that the served ball has bounced for the first time after the service contact between racket and ball. This message is transmitted by depression of a preselected key on the umpires keyboard input unit. The computer acts on receipt of this message to select new sets of definitions of in-play channels and out-of-play channels, such sets being indicated in Table 2.

If the served ball has bounced on an in-play area not monitored by the detection system, play will continue with the detection system monitoring as in-play and out-of-play channels those indicated in Table 2.

If at any stage during play of the contested point, the detection system interrupts the computer with the information that the ball has bounced on an in-play channel, the computer stores the corresponding interrupt word in its memory until the umpire again transmits the message denoted B.

If during play of the contested point subsequent to an in-play service bounce, the detection system interrupts the computer with the information that the ball has bounced on an out-of-play channel, the computer activates an audible alarm on the visual display unit and disables interrupts from the detection system. The umpire can then display the latest score as indicated by the computer (as well as the previous score) and indicate to the computer his agreement with the (edited) latest score by transmission of the message denoted C.

If during play of the contested point subsequent to an in-play service bounce the ball has bounced on an out-of-play area not monitored by the detector system, the umpire will decide that the ball bounced out-of-play and transmit the message denoted B which disables interrupts from the detection system. The umpire next inputs the latest score and transmits it to the computer using the message denoted C.

If during play of the contested point an unusual event should occur, the umpire will transmit to the computer the message denoted B and will finally transmit the (edited) latest score to the computer using the message denoted C.

With suitable adaption the above described computer system could assist umpires, referees or judges in the games of squash, foot ball, golf, table tennis, hockey, baseball, billiards, snooker, netball and basket ball.

I claim:

1. A tennis ball comprising suitably shaped panels of electrically conductive cloth bonded to a substantially spherical flexible core by means of a suitable adhesive and the application of heat, said cloth including electrically conductive material substantially uniformly distributed through said cloth from the outer surface of said flexible core to the outer surface of said ball.

2. A tennis ball as defined in claim 1 whose cloth cover includes metal making the cloth electrically conductive.

3. A tennis ball as defined in claim 2 wherein said metal is stainless steel, aluminum or copper.

4. A tennis ball as defined in claim 2 wherein said metal is included with the cloth by weaving.

5. A tennis ball as defined in claim 2 wherein said metal is included with the cloth by stitching.

6. A tennis ball as defined in claim 2 wherein said metal is included with the cloth by needling.

7. A tennis ball as defined in claim 1 whose cloth cover includes non-metal making the cloth electrically conductive.

8. A tennis ball as defined in claim 7 wherein said non-metal included with the cloth is carbon fibre.

9. A tennis ball as defined in claim 1 wherein the electrically conductive outer surface is suitable coloured by dyeing.

10. A tennis ball as defined in claim 1 whose cloth cover is made from wool, nylon and said electrically conductive material, said electrically conductive material having been associated with one of said other components prior to making of the cloth.

11. A tennis ball as defined in claim 1, wherein said cloth is made from wool, nylon and stainless steel.

* * * * *

UNITED STATES PATENT AND TRADEMARK OFFICE

CERTIFICATE OF CORRECTION

PATENT NO. : 4,071,242

DATED : January 31, 1978

INVENTOR(S) : Lyle David Supran

It is certified that error appears in the above-identified patent and that said Letters Patent are hereby corrected as shown below:

Column 4, line 47, "malt" should read --matt--

Column 4, line 59, "(terminal 10)" should read-(terminal 110)--

Column 5, line 31, "0 4 and 5" should read --0, 4 and 5--

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*